US006431334B1

(12) United States Patent
Lin

(10) Patent No.: US 6,431,334 B1
(45) Date of Patent: Aug. 13, 2002

(54) TRAVEL BAG WITH PROTECTED ZIPPERS

(75) Inventor: Shin-Fu (Eiken) Lin, Hsi-Chih Taipei (TW)

(73) Assignee: Paragon Luggage, Inc., Irvine, CA (US)

( * ) Notice: Subject to any disclaimer, the term of this patent is extended or adjusted under 35 U.S.C. 154(b) by 0 days.

(21) Appl. No.: 09/635,453

(22) Filed: Aug. 11, 2000

(51) Int. Cl.[7] ..... A45C 13/10; A45C 13/00
(52) U.S. Cl. ..... 190/120; 190/115; 190/903
(58) Field of Search ..... 13/279, 276; 190/115, 190/903, 120

(56) References Cited

U.S. PATENT DOCUMENTS

| | | | | | |
|---|---|---|---|---|---|
| 2,574,089 | A | * | 11/1951 | Cochran | 190/109 |
| 3,292,748 | A | * | 12/1966 | Rifkin | 190/903 X |
| 3,613,843 | A | * | 10/1971 | Davis | 190/120 |
| 3,965,706 | A | * | 6/1976 | Davis | 190/903 X |
| D250,087 | S | * | 10/1978 | Stark | 190/109 |
| 4,164,797 | A | * | 8/1979 | Golembeck | 190/109 |
| 4,397,378 | A | * | 8/1983 | Lee | 190/903 X |
| D286,229 | S | * | 10/1986 | Knoepke et al. | 190/903 X |
| 4,733,549 | A | * | 3/1988 | Baker | 190/120 |
| 4,733,759 | A | * | 3/1988 | Shih-Chen | 190/903 X |
| 5,645,146 | A | * | 7/1997 | Bieber et al. | 190/115 X |
| 5,875,876 | A | * | 3/1999 | Wang | 190/18 A |
| 6,050,374 | A | * | 4/2000 | Johnston | 190/115 X |

FOREIGN PATENT DOCUMENTS

| | | | | |
|---|---|---|---|---|
| FR | 2773681 | * | 1/1998 | A45C/5/14 |

* cited by examiner

*Primary Examiner*—Lee Young
*Assistant Examiner*—Tri M. Mai
(74) *Attorney, Agent, or Firm*—Jack A. Kanz

(57) ABSTRACT

Zipper closures, luggage locks attached to zipper closures and retractable handles on travel bags are protected by covers which conceal such luggage hardware when in the closed or retracted position. The protective covers are in the form of rectangular flaps or the like which have one edge secured to the bag and aligned so that the flap is extendable over and attached or attachable to the bag on the opposite side of the zipper or handle so that the luggage hardware is covered and protected during transit.

7 Claims, 3 Drawing Sheets

TRAVEL BAG WITH PROTECTED ZIPPERS

This invention relates to travel bags. More particularly, it relates to luggage such as soft-sided travel bags and the like which employ zipper closures and to protection of such zipper closures during transit.

Zippers are commonly used as the primary closure mechanism for a wide variety of travel bags. Furthermore, many bags (such as soft-sided trolley bags and the like) employ zippers to close pockets on the bag which are accessible from outside the bag. As a result, the zipper closure mechanism is exposed and subject to damage or accidental opening. While luggage locks are commonly employed to secure zipper closures in the closed position and prevent accidental opening or tampering, the zipper closures (and locks) remain exposed and may be damaged by contact with other baggage and/or may be caught on or by other baggage or baggage handling equipment, resulting in damage to the zipper, the zipper closure, other parts of the bag and/or other bags and baggage handling equipment. Similarly, many travel bags employ trolleys or wheels on one end of the bag with a retractable handle which extends from the opposite end of the bag for dragging the bag instead of carrying its full weight. Such retractable handles are frequently accidentally extended during handling and transit, resulting in damage to the bag, the handle, other baggage and/or baggage handling equipment. Damages caused by exposed zipper closures and accidentally extended retractable handles have long plagued travelers and the travel industry.

In accordance with the present invention travel bags are provided with closeable flaps or pockets which enclose and/or shield zipper closures and retractable handles during transit. The protective flaps, pockets, etc., are positioned on the travel bag to enclose or shield the zipper closures and retractable handles and thus prevent accidental snagging of other objects but may be conveniently opened as required to permit access to the closure mechanism and opening of the bag, pockets or handles as desired. The pockets, flaps, etc., are preferably flexible but durable material which does not readily catch or become caught by other objects and is soft enough to prevent scuffing or scraping of other objects with which they are brought into contact. The pockets or flaps thus not only protect the closures and handle mechanisms from damage or accidental opening, they also prevent the zipper closures from scraping, snagging or otherwise damaging other bags, baggage handling equipment and the like. Other features and advantages of the invention will become more readily understood from the following detailed description taken in connection with the appended claims and attached drawing in which:

Figure 1:
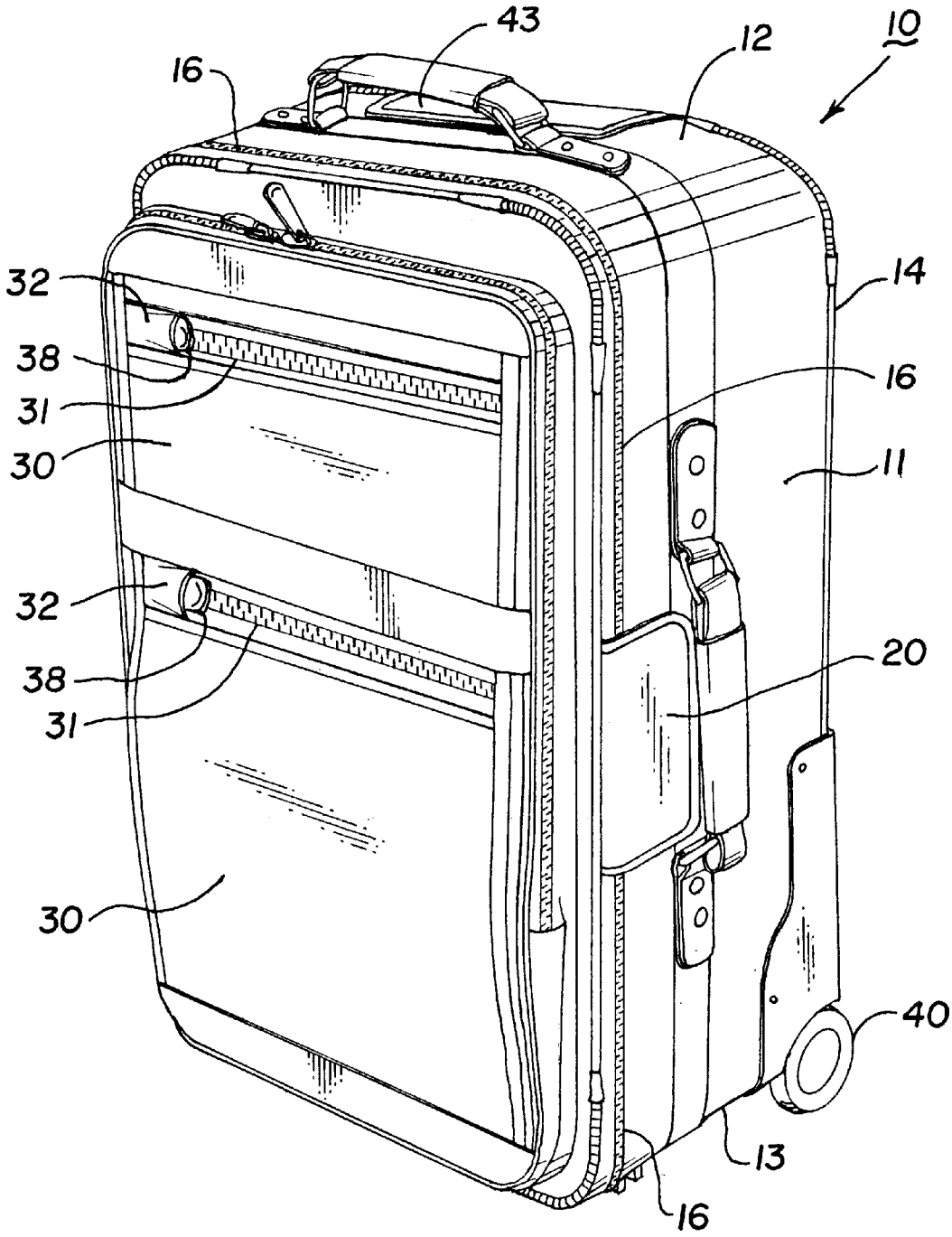
FIG. 1 is a perspective view of a travel bag which employs various embodiments of the protective pockets and flaps of the invention.

The drawing is incorporated into and forms part of this specification to illustrate exemplary embodiments of the invention. Throughout the drawing like reference numerals designate corresponding elements. It will be recognized that the principles of the invention may be utilized and embodied in many and various forms. In order to demonstrate these principles, the invention is described herein by reference to specific preferred embodiments. The invention, however, is not limited to the specific forms illustrated and described. Furthermore, the invention is not limited to use in connection with soft-sided bags or trolley bags but may find utility in other similar applications.

For purposes of this disclosure, the term "travel bag" is used to mean any portable container with a zipper closure. Similarly, "zipper" is used to mean any mechanism in which interlocking members arranged parallel with each other on opposite sides of an opening are reversibly joined or separated by a closure device which slides along the length of the parallel interlocking members to join or separate the parallel interlocking members and thus close or open the opening.

A wheeled travel bag 10 is illustrated in FIG. 1 which comprises a case 11 having an upper end 12, a lower end 13, a bottom 14 and a top 15. As in conventional soft-sided luggage, the top 15 is hingedly attached to one top edge of the case 11 to permit access to the interior of case 11 and secured to the other three (3) top edges by a zipper 16. Zipper 16 is opened and closed by a zipper closure device 17 which slides along the parallel members of the zipper to alternatively open or close the zipper 16. In most cases, the zipper 16 employs two (2) oppositely disposed zipper closures 17, each of which slides from the hinge toward the other zipper closure 17 so that the two zipper closures 17 may meet at any position along the length of the zipper 16 to close the bag. Conventionally, the sliding zipper closures 17 include hinged tabs 18 which may be secured together by a luggage lock 19 or the like for security.

When the bag 10 is closed, the position of closure hardware 17, 18 and lock 19 on the bag 10 must always be at a perimeter dictated by the zipper 16. Accordingly, the closure hardware 17, 18 and lock 19 are always exposed to contact with other objects and thus subject to being damaged or causing damage. According to the invention, one edge of a protective flap 20 is attached to either the top 15 or the case 11 parallel with zipper 16 so that the flap may extend over and cover a linear section of zipper 16. As illustrated in FIG. 1 the flap 20 is positioned midway up the vertical side of case 11. However, the flap 20 may be positioned at any desired location along the track of zipper 16. Similarly, the flap 20 as shown in FIG. 1 is attached to the top 15 and folds over zipper 16 toward case 11. Obviously, the position of the flap could be reversed.

Figure 2:
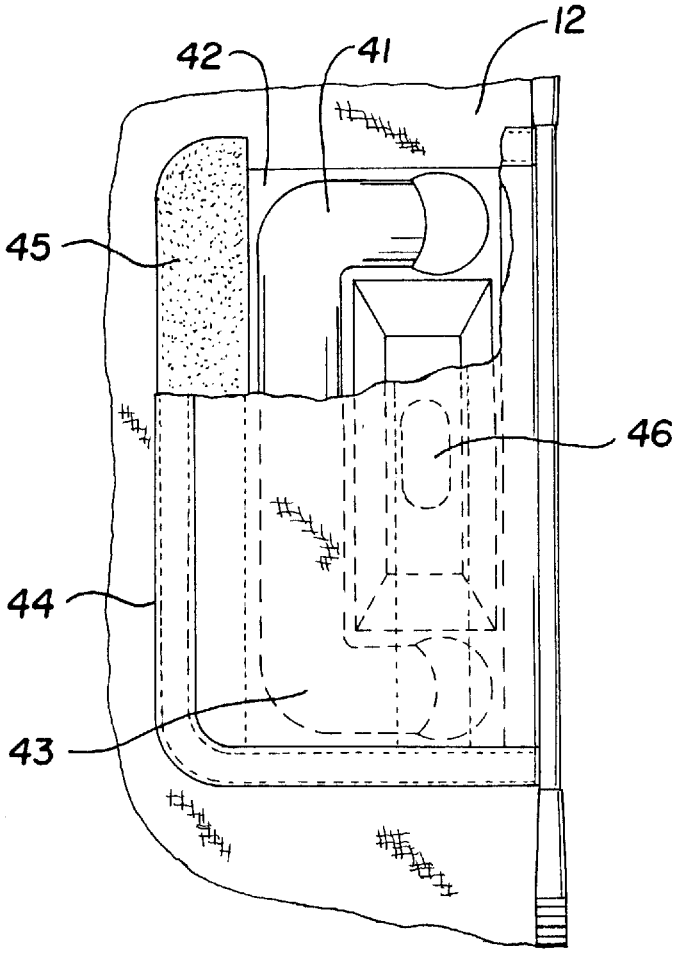
FIG. 2 is a fragmentary top plan view, partially in broken away, of a travel bag employing a closeable flap for protecting the retractable handle.
Figure 3:
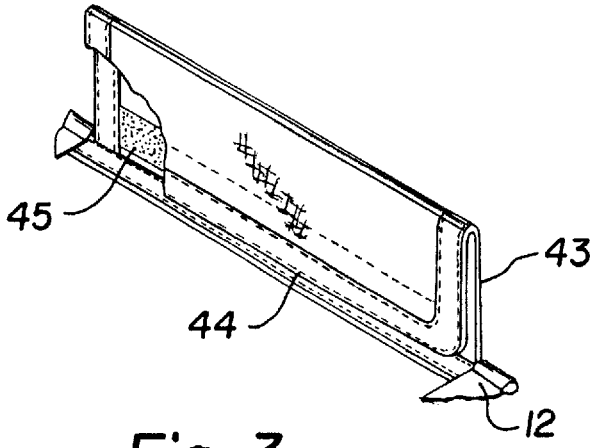
FIG. 3 is a perspective view, partially broken away, of the protective flap of FIG. 2 illustrating an alternative open position of the flap in accordance with one embodiment of the invention.

Flap 20 has an axial length with respect to the zipper 16 (vertically as shown in FIG. 2) sufficient to cover the closure hardware 17, 18 and lock 19 and is preferably formed of soft but durable material. If desired, the flap 20 may even contain padding. As shown in FIG. 1 flap 20 is aligned to overlie the zipper 16 and extend over a portion of case 11 adjacent and parallel with the surface of case 11. In the preferred embodiment the interior surface of flap 20 adjacent the free edge 21 is adapted to mate with and be removeably secured to the adjacent surface of case 11. The attachment means is preferably a hook and pile closure (commonly known as VELCRO) or the like. Preferably the hook side 22 of the closure is adjacent the free edge 21 and the pile side 23 secured to the surface of case 11. Accordingly, with the closure hardware 17, 18 and lock 19 positioned adjacent the flap 20, flap 20 may be folded over the closure hardware and secured to the case 11 as shown in FIG. 1. In this position, flap 20 totally conceals and protects the closure hardware 17, 18 and lock 19. The closure hardware and lock, however, can be readily exposed as desired by pulling the free edge 21 of flap 20 from the case 11.

It will be appreciated that other mechanisms may be used for securing the flap 20 to the case 11 such as zippers, snaps, buttons, adhesives, etc. Alternatively, if the flap 20 is sufficiently stiff and properly attached to the top 15 or case 11, a mechanism for securing the free edge 21 of the flap 20 may be unnecessary.

Figure 4:
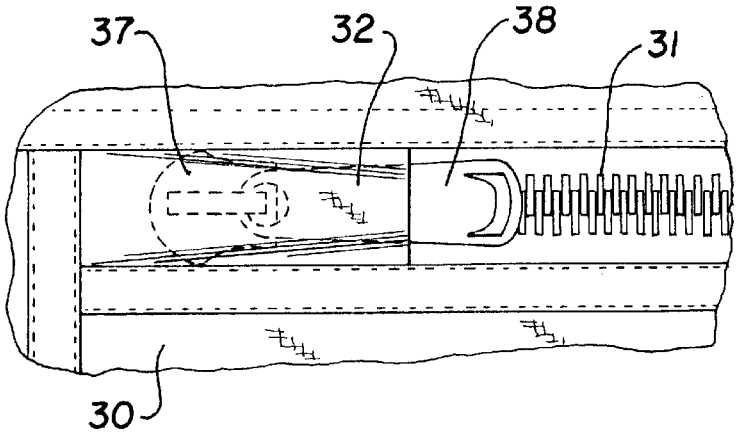
FIG. 4 is a fragmentary front elevational view of the bag of FIG. 1 illustrating an embodiment of protective pocket for a zipper closure.
Figure 5:
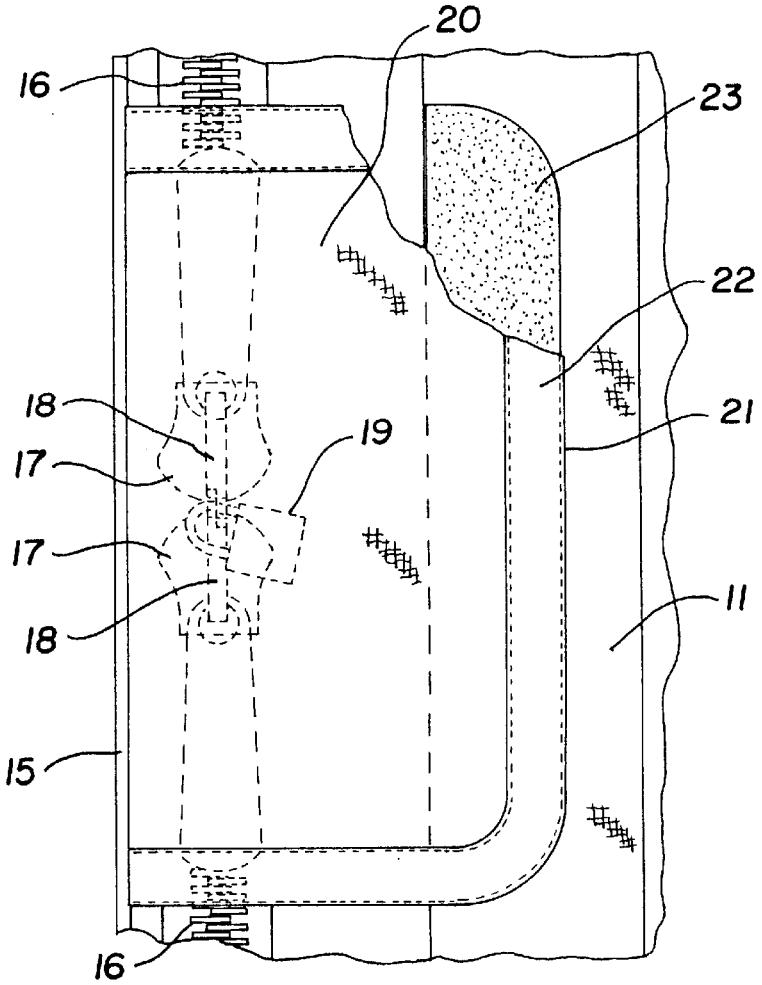
FIG. 5 is a fragmentary side elevational view, partially broken away, illustrating the preferred embodiment of a flap for enclosing and protecting the zipper closure mechanism of the primary closure zipper of the bag illustrated in FIG. 1.

As illustrated in FIG. 1, many soft-sided travel bags include pockets 30 on an exterior surface of the bag (on the top 15 as shown in FIG. 1) which are accessible from outside the bag. Ordinarily, such pockets 30 are closed with zippers 31. The zipper closures 37 and tabs 38 on zippers 31, like zipper closures 17 and tabs 18 on the primary closure zipper 16, are therefore exposed and subject to damage. To protect the zipper hardware, a hood or pocket 32 is provided into which zipper closure 37 is positioned when the zipper 31 is closed. In the preferred embodiment, hood 32 is a section of heavy fabric, plastic or the like which is secured to opposite edges of the zipper and bridges the end of the zipper at the closed position. Accordingly, the zipper closure device 37 is pushed into hood 32 when the zipper in the closed condition so that only the free end of tab 38 remains exposed as illustrated in FIG. 4. In the preferred embodiment the diameter of the cavity formed by hood 32 decreases from the entry end so that the hood 32 forms a pocket having at least one open end and a semi-cylindrical or semi-conical shape. Accordingly, when zipper closure device 37 is forced into the hood 32, it is secured therein but may be withdrawn at will. The hood 32, however, holds the zipper closure device 37 therein and holds the tab 38 securely against the zipper 31 during transit to prevent the closure device 37 or tab 38 from contacting other objects and thus preventing accidental opening of the zipper or damage to the zipper or other objects.

Trolley bags such as bag 10 shown in FIG. 1 conventionally employ trolleys or wheels 40 affixed to the lower end of the bag and a retractable handle 41 (see FIG. 2) which extends into the bag and is withdrawn through the upper end 12. In some cases the retractable handle 41 fits within a depression or well 42 in the upper end 12 of the bag 10 when in the fully retracted position so that the handle 41 is somewhat protected from contact with other objects. In some cases the retractable handle 41 includes a latch which is intended to secure the handle 41 in the retracted position during transit. Such latches, however, have been found to be less than reliable. Accordingly, the retractable handle 41 is frequently dislodged and accidentally extended during transit and handling. When accidentally extended the handle 41 may be damaged, the bag 10 may be damaged, and/or the extended handle may be caught on and cause damage to other objects such as other baggage, baggage handling equipment and the like.

To prevent accidental extension of handle 41 (and to improve aesthetics), a flap 43 may be used to cover the handle 41 and well 42. The flap 43 is extendable over the well 42 so that its free edge 44 may be secured to the surface of upper end 12 of the case 11 (as illustrated in FIG. 1). When the free edge 44 is secured to the surface of upper end 12 of the case 10, well 42 and the handle 41 therein are fully encased and concealed. Accordingly, the flap 43 serves not only to lock the retractable handle 41 in place, it also serves to provide a flush surface which prevents foreign objects from accidentally catching on handle 41.

As illustrated in FIG. 2 the free edge 44 of flap 43 is releaseably secured to the case 10 by attachment means such as a hook and pile closure (commonly known as VELCRO) or the like. Other devices such as zippers, snaps, buttons, adhesives, etc., may be used. Because of the size of well 42, the flap 43 must be rather large to cover the entire well 42 when closed. Accordingly, when the handle is extended the flap 43 must be pivoted away from the well 42 and thus presents a rather large free-standing flap which is not only unsightly but tends to catch on other objects. According to the invention, the internal surface of the flap 43 adjacent the edge which is secured to the case 11 is provided with means 46 for temporarily securing the free edge 44 of the flap 43. The means for securing the free edge 44 may be either the hook or pile portion of the hook and pile closure which mates with the hook or pile portion on the free edge 44 of the flap 43 so that when flap 43 is folded along its centerline, the free edge 44 is secured to the attachment means 45 inside the flap 43 and remains securely folded in place. In this manner the free edge 44 of the flap 43 is confined and the extended length of flap 43 reduced. Other means for temporarily securing the free edge 44 of flap 43 may be employed such as snaps, buttons, zippers, slots, pockets and the like which hold the flap 43 in a folded condition but permit the flap 43 to be released and unfolded as desired and re-applied to attachment means 45 and completely enclose and cover the well 42 when the handle 41 is again retracted. It will be recognized that attachment means 46 may be the pile of fabric which forms the inner surface of flap 43.

Protective flaps, hoods, pockets, etc., as described above have been found extremely effective in concealing and protecting luggage zippers and handles from damage during transit and protecting other baggage and baggage handling equipment from damage by such zippers and handles. The flaps, hoods, pockets, etc., of the invention may be made of various commonly available materials such as ballistic nylon and/or plastics commonly used in making soft-sided luggage. Similarly, the flaps, hoods, pockets, etc., may be formed in various other shapes and designs as desired for aesthetics or function. It is to be understood, therefore, that even though numerous characteristics and advantages of the invention have been set forth in the foregoing description together with details of the structure and function of various embodiments, this disclosure is to be considered illustrative only. Various changes and modifications may be made in detail, especially in matters of shape, size, arrangement and combination of parts, without departing from the spirit and scope of the invention as defined by the appended claims.

What is claimed:

1. A travel bag comprising:

(a) a case body having an upper end, a lower end, a bottom and a hinged top which permits access to the interior of the case;

(b) wheels affixed to said lower end;

(c) a retractable handle extendable from said upper end;

(d) a zipper with a zipper closure for closing the hinged top to the case body;

(e) a flap positioned to lie over and conceal said retractable handle when said handle is retracted and having a first edge secured to said travel bag; and (f) means for alternatively securing a second edge of said flap to either (i) said travel bag so that said flap covers said handle when said handle is retracted or (ii) a surface of said flap to hold said flap in a folded condition when said handle is extended.

2. A travel bag as defined in claim 1 wherein said handle is positioned within a recessed well when retracted and said flap extends across said well to conceal said handle.

3. A travel bag comprising:

(a) a case having an upper end, a lower end, a bottom and a hinged top which permits access to the interior of said case;

(b) wheels affixed to said lower end;

(c) a retractable handle extendable from said upper end;

(d) a pocket on said hinged top which has an opening providing access to said pocket from outside said case;

(e) a zipper having a zipper closure which is moveable in one direction to open said opening and in the opposite direction to close said opening; and (f) a flap secured to said hinged top adjacent opposite sides of said zipper to form a hood which substantially covers said zipper closure when said zipper is in the closed position.

4. A travel bag as defined in claim 3 wherein said hood forms a semi-conical shape.

5. A travel bag as defined in claim 4 wherein one end of said hood is substantially flattened.

6. A travel bag as defined in claim 3 wherein said hood forms a semi-cylindrical shape.

7. A travel bag as defined in claim 6 wherein one end of said hood is substantially flattened.

* * * * *